US006129508A

United States Patent [19]

Bähr et al.

[11] Patent Number: 6,129,508

[45] Date of Patent: Oct. 10, 2000

[54] SIDE CHANNEL COMPRESSOR

[76] Inventors: Hubertus Bähr, Merklachweg 55, D-97631 Bad Königshofen; Peter Krummen, Bergblick 3, D-97640 Oberstreu, both of Germany

[21] Appl. No.: 09/230,475

[22] PCT Filed: Jul. 15, 1997

[86] PCT No.: PCT/DE97/01492

§ 371 Date: Dec. 29, 1999

§ 102(e) Date: Dec. 29, 1999

[87] PCT Pub. No.: WO98/04836

PCT Pub. Date: Feb. 5, 1998

[30] Foreign Application Priority Data

Jul. 30, 1996 [DE] Germany ..... 296 13 186

[51] Int. Cl.[7] ..... F04D 05/00

[52] U.S. Cl. ..... 415/55.1; 415/55.4; 415/170.1; 415/173.1; 415/173.3

[58] Field of Search ..... 415/55.1, 55.2, 415/55.3, 55.4, 170.1, 173.1, 173.3, 174.2, 174.3

[56] References Cited

U.S. PATENT DOCUMENTS 4,279,570 7/1981 Egli et al. .

5,658,126 8/1997 Werner et al. ..... 415/55.1

FOREIGN PATENT DOCUMENTS 0 478 468 4/1992 European Pat. Off. .

0 708 248 10/1995 European Pat. Off. .

2199340 4/1974 France .

42 44 458 7/1993 Germany .

59-128993 7/1984 Japan ..... 415/174.3

*Primary Examiner*—Edward K. Look

*Assistant Examiner*—Liam McDowell

[57] ABSTRACT

The invention relates to a side channel compressor having an impeller (2) which is arranged rotatably in the housing (1) of the compressor and has a carrying ring (3) which is provided with feed vanes (4) and, at least on one side, projects axially beyond a hub part (5) which bears the carrying ring and connects it to a drive shaft, in the case of which compressor, in the region of the carrying ring (3), a sealing ring (6), which butts against the inner circumference of the axially projecting part of the carrying ring (3) and seals the gap (13) present between the impeller (2) and the housing (1), is retained, by means of a retaining ring (8), in a state clamped against an abutment surface provided on the housing (1). The installation is simplified in that a centering border (10) which aligns the sealing ring (6) is provided on the abutment surface.

1 Claim, 1 Drawing Sheet

SIDE CHANNEL COMPRESSOR

BACKGROUND OF THE INVENTION

The present invention relates to a side channel compressor, in which an impeller is arranged rotatably in the housing of the compressor and has a support ring which is provided with transport blades and, at least on one side, projects axially beyond a hub part which bears the support ring and connects it to a drive shaft. In the region of the support ring, a radially extending sealing ring butts against an inner circumference of an axially projecting part of the support ring and seals the gap present between the impeller and the housing. The sealing ring is retained by means of a retaining ring, in a state clamped against an abutment surface provided on the housing.

Such a side channel compressor is known from EP-A-0 708 248. In the case of this known compressor, a sealing ring is retained, by means of a retaining ring, in a state clamped against an abutment surface provided on the housing of the side channel compressor. The sealing ring extends radially as far as the support ring, which carries the vanes of the side channel compressor, and butts against the inner circumference of said support ring. In order to achieve good sealing, the sealing ring has to butt satisfactorily against each point of the inner circumference. This presupposes very precise central alignment of the sealing ring, which can only be achieved by way of correspondingly high installation outlay.

SUMMARY OF THE INVENTION

The object of the invention is to develop a side channel compressor of the general type noted above such that the sealing ring can be installed in a straightforward manner with a high degree of alignment accuracy.

The object is achieved by means of a centering border which aligns the sealing ring, and which is provided on the abutment surface. For accurate alignment, all that is needed is for the sealing ring to be pushed into the centering border. The centering border itself can be produced in a straightforward manner, as by a turning operation.

BRIEF DESCRIPTION OF THE DRAWINGS

The invention is described in more detail hereinbelow with reference to an exemplary embodiment illustrated in the drawing, in which.

DETAILED DESCRIPTION

Figure 2:
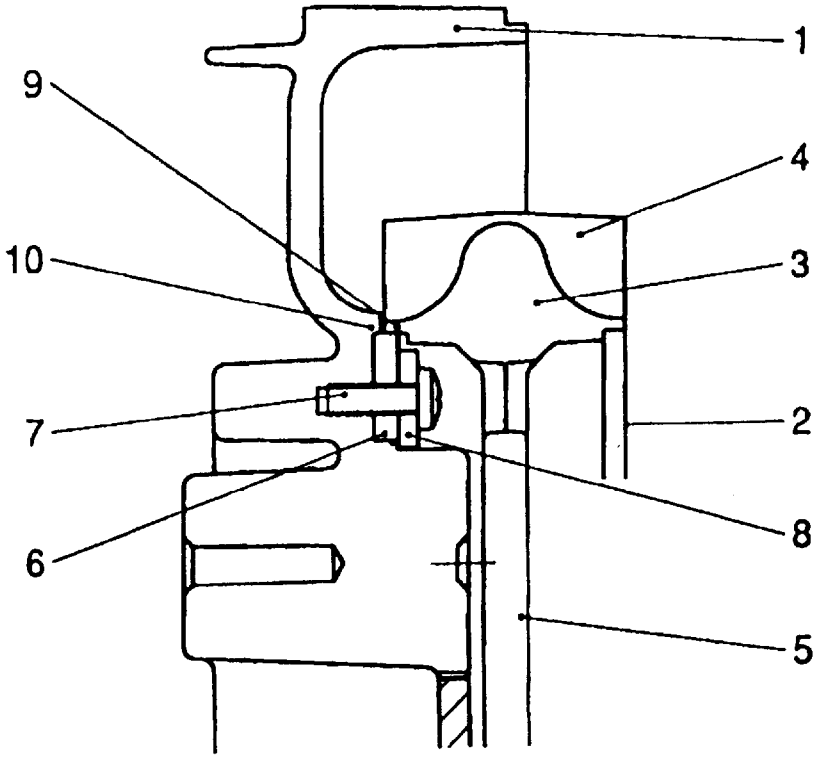
FIG. 2 shows a partial longitudinal section of a side channel compressor with a second embodiment of a centering border.

In the figures, one half of a housing of a side channel compressor is designated by numeral 1. Two housing halves 1 joined together provide a complete housing that encloses an impeller 2 that is arranged on a drive shaft (not illustrated in the figures). On its outer circumference, the impeller 2 has a support ring 3 on which the transport blades 4 of the impeller 2 are arranged. The support ring 3 is arranged on a hub part 5 which is fitted on the drive shaft and which is connected to the latter in a rotationally fixed manner.

A sealing arrangement is provided on each housing half 1, in the region which borders the support ring 3 radially inside the latter. This sealing arrangement comprises a plastic sealing ring 6 which is retained, by means of a retaining ring 8 which is fastened by means of screws 7, against a corresponding abutment surface provided on the housing wall of the respective housing half 1.

A corner recess 9 is produced on each end side of the support ring 3 by turning, and the sealing ring 6 engages in said corner recess. The sealing ring 6 butts, by way of its outer circumference, against the inner circumference of the axially extending wall part of the corner recess 9. Production of the corner recess 9 by turning results in a high degree of dimensional accuracy as regards the diameter of the corner recess 9. Since the sealing ring 6 can also be produced with a high degree of accuracy as regards its external diameter, a good sealing action can be achieved by precise central alignment of the sealing ring.

The sealing ring 6 is aligned centrally by means of a centering border 10 provided on the respective housing half 1. All that is then required is for the sealing ring 6 to be pushed in behind this centering border 10. The centering border 10 results in the sealing ring 6 being fixed in a positively locking manner, as a result of which the sealing ring 6 is prevented from moving radially outward.

Figure 1:
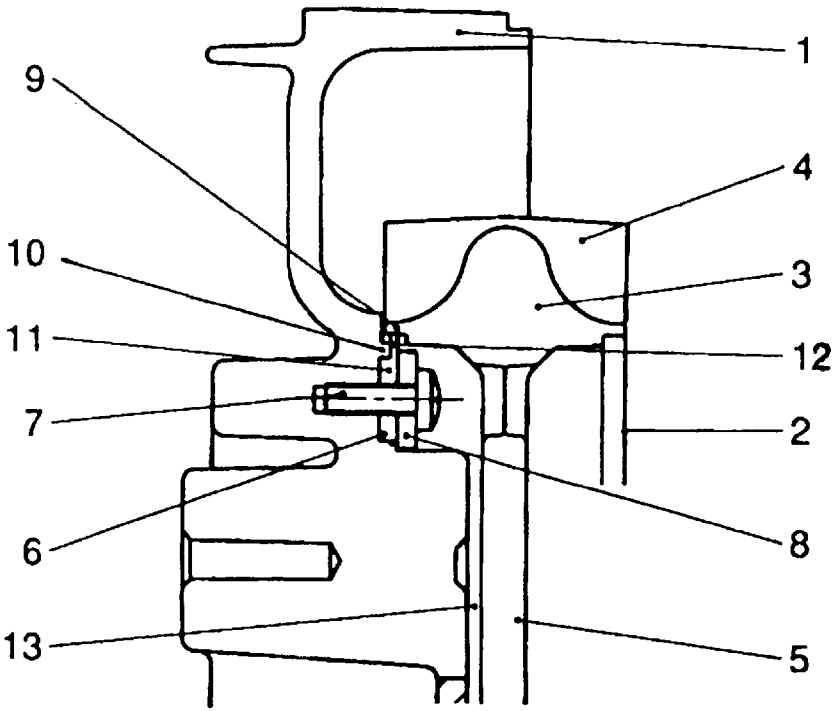
FIG. 1 shows a partial longitudinal section of a side channel compressor with a first embodiment of a centering border.

In the case of the exemplary embodiment according to FIG. 1, a centering extension 11 which has its external diameter adapted to the internal diameter of the centering border 10 is provided on the sealing ring 6. An annular extension 12 which is directed radially outwards with respect to said centering extension 11 extends to the corner recess 9 and butts against the axially extending wall part of the corner recess 9.

In the case of the exemplary embodiment according to FIG. 2, the external diameter of the sealing ring 6 corresponds to the internal diameter of the centering border 10. The sealing ring 6 is dimensioned to be correspondingly thick in the axial direction, with the result that it projects axially with respect to the centering border 10 and engages in the corner recess, the sealing ring butting against the axially extending wall part of the corner recess 9 and thus sealing the gap 13 present between the impeller 2 and the respective housing half 1.

This makes it possible to reduce to a considerable extent the leakage losses which take place via the gap 13 present between the impeller 2 and the respective housing half 1.

What is claimed is:

1. A side channel compressor, comprising:

a housing;

a hub mounted onto a drive shaft;

an impeller which is rotatably arranged within the housing of the compressor, the impeller having a support ring that has transport blades, the support ring being mounted onto the hub and, at least on one side, projecting axially beyond the hub, which bears the support ring and connects it to the drive shaft;

a radially extending sealing ring in the region of the support ring, which butts against an inner circumference of the axially projecting part of the support ring and which seals a gap located between the impeller and the housing;

a retaining ring for retaining the sealing ring clamped against an abutment surface provided on the housing, wherein a centering border which aligns the sealing ring is provided on the abutment surface.

* * * * *